United States Patent [19]

Ballet

[11] Patent Number: 4,916,780

[45] Date of Patent: Apr. 17, 1990

[54] SAFEGUARDING BUCKLE FOR A SAFETY BELT

[75] Inventor: Jean-Noël Ballet, Aillevilliers, France

[73] Assignee: ECIA-Equipements Et Composants Pour l'Industrie Automobile, Audincourt, France

[21] Appl. No.: 354,176

[22] Filed: May 19, 1989

[30] Foreign Application Priority Data

Jun. 2, 1988 [FR] France ..... 88 07370

[51] Int. Cl.[4] ..... A44B 11/25

[52] U.S. Cl. ..... 24/642; 24/639

[58] Field of Search ..... 24/642, 640, 639, 641, 24/637, 638, 635, 652

[56] References Cited

U.S. PATENT DOCUMENTS

| | | | |
|---|---|---|---|
| 3,967,797 | 7/1976 | Drew | 24/603 |
| 4,094,046 | 6/1978 | Takada | 24/642 |
| 4,393,554 | 7/1983 | Wier | 24/652 |
| 4,543,694 | 10/1985 | Föhl | 24/642 |
| 4,624,034 | 11/1986 | Ishiguro et al. | 24/639 |
| 4,660,260 | 4/1987 | Ishiguro | 24/638 |
| 4,797,984 | 1/1989 | Seto | 24/641 |

FOREIGN PATENT DOCUMENTS

| | | |
|---|---|---|
| 1960967 | 6/1970 | Fed. Rep. of Germany . |
| 2590134 | 5/1987 | France . |

*Primary Examiner*—Victor N. Sakran

*Attorney, Agent, or Firm*—Sughrue, Mion, Zinn, Macpeak & Seas

[57] ABSTRACT

The buckle comprises a latch (10) interacting with a keeper consisting of a base (20), of an ejecting guide bolt (30), of an actuating button (50), of a protective casing (60) and of a securing connection (70), among other things. Means (40) having an insertion and retention system (301, 302, 303, 304), a safeguarding arrangement (410, 420) and a guide device (430, 440) make it possible to safeguard the locked latch in the keeper after it has been introduced into a channel (200) and a receptacle (300) which are oblique relative to one another.

The invention is used on safety belts for motor vehicles.

20 Claims, 7 Drawing Sheets

FIG.3A
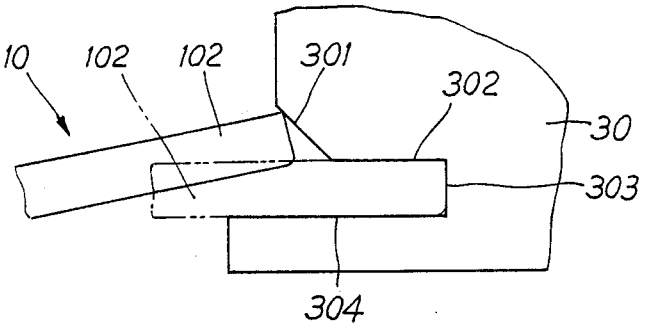
FIG.3B
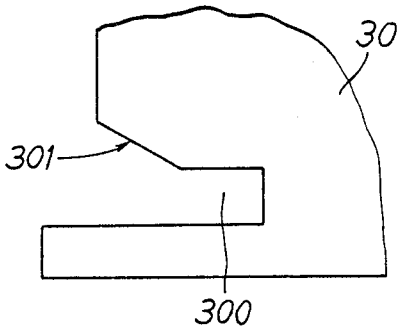
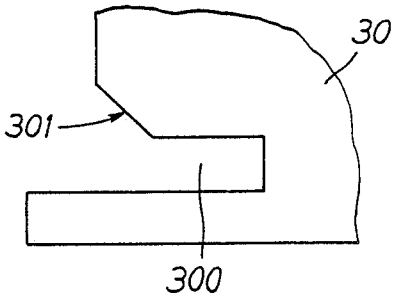
FIG.3C
FIG.3D
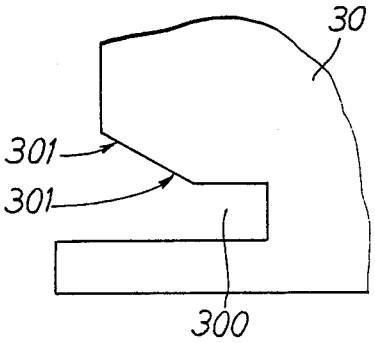

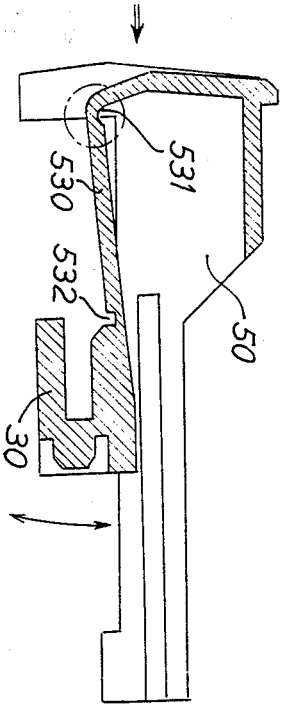
FIG.6A
FIG.6B
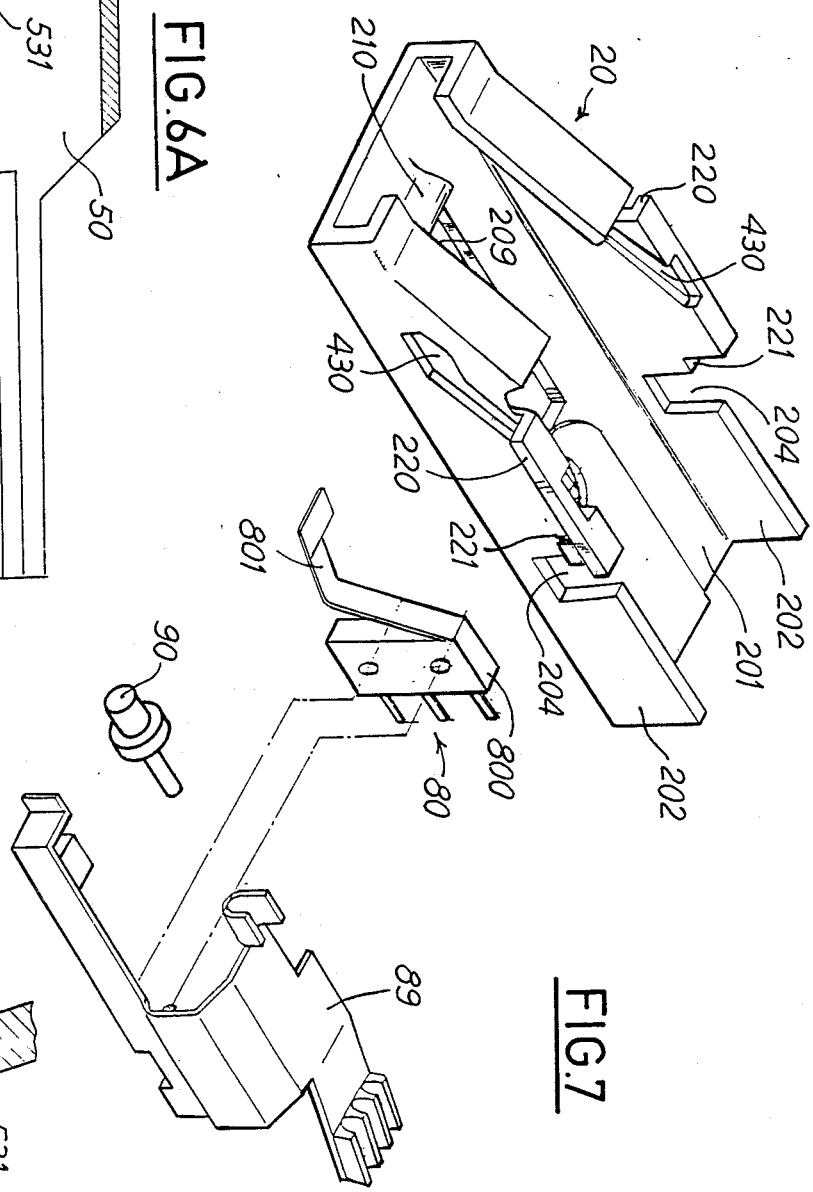
FIG.7

SAFEGUARDING BUCKLE FOR A SAFETY BELT

The present invention relates to buckles for safety belts and, more particularly, to those intended for motor vehicles preferably used on land.

As is known, motor vehicles, especially land vehicles, are equipped with safety belts which must satisfy a stringent set of specifications usually drawn up, at least partially by the public authorities.

Under normal conditions, when a safety belt is not acting in order to retain an occupant of the vehicle on his seat, as it does in the event of violent shock, the belt band normally rests against its wearer's body, if necessary under the action of a very slight tension exerted by a return mechanism of a reeling device. Under such conditions, it is relatively easy to open the buckle of a belt.

In other circumstances, especially when a vehicle has overturned as the result of an accident, the band of the safety belt is subjected to a tension which can be considerably higher; this tension is that exerted, for example, by the weight of an occupant who is supported or suspended by the band when the vehicle has turned over. Under such conditions, it must be possible for the buckle of the safety belt to be opened relatively easily by the occupant himself or a third party, in order to free the person held in this way. This is difficult to achieve, because in such a situation the tension of the belt is of the order of approximately 50 daN to 60 daN, and it must be possible to open the buckle by exerting a force of the order of 25 daN which is extremely difficult to generate in practise.

Furthermore, it is essential that, under an actual violent shock when the safety belt retains the occupant on his seat and its tension exceeds 100 daN for the brief moment of absorption of the kinetic energy, the locked buckle should not open inopportunely at an especially unfavourable moment, with the risk that its effectiveness will be nullified completely. To achieve this, buckles which, once locked, are kept safeguarded in this state have already been envisaged.

A buckle for a safety belt with a locking safeguard is described, for example, in French Patent Application No. 2,590,134.

This document describes various alternative versions of safety-belt buckles with a locking safeguard. All the embodiments described there conform to the standards, but they are somewhat complex to produce. Although such a complex construction does not impair the reliability of these buckles, it is nevertheless an obstacle to ensuring relatively low production and assembly costs. Moreover, there is a relative lack of accuracy in these buckles during the phase when the latch is introduced into the keeper of the buckle.

The object of the invention is to provide a buckle for a safety belt, especially of motor vehicles, for example land vehicles, with a locking safeguard, which, whilst affording the advantages of the buckle just mentioned, does not have its disadvantages particularly in economic terms.

The subject of the invention is a buckle for a safety belt, especially of motor vehicles used on land, which is intended for connecting a band to an anchorage point and which is composed particularly of a latch and of a keeper which comprises, among other things, a base and, carried by this, an ejecting guide bolt, an actuating button and preferably a protective casing.

This buckle according to the invention is such that this base delimits the channel for receiving the latch at least partially and is equipped with a nose on which the latch can catch directly when it is locked on the keeper, this ejecting guide bolt delimits the receptacle for receiving the latch at least partially and is mounted on the base movably between a first retaining position, towards which it is normally stressed elastically, and a second position, towards which it is pushed momentarily during the introduction of the latch into the keeper for locking it, and this actuating button is mounted on the base movably in terms of translational motion between an inactive position, towards which it is normally stressed elastically and which it occupies when the ejecting guide bolt is in its first position, and an active position for causing the ejecting guide bolt to pass from its first position to its second position in order to release the latch from the keeper.

The buckle according to the invention is characterized in that the channel and the receptacle are inclined relative to one another and are oriented in such a way that the channel has a slant rising in the direction of the receptacle, in that the ejecting guide bolt, when it moves from its first position to its second position, follows a path in the form of a broken line first approximately parallel to the receptacle and then oblique relative to the latter, and vice versa, and in that it possesses means for safeguarding the ejecting guide bolt in its first position, for inserting and retaining the latch in the receptacle of the ejecting guide bolt during the introduction of the latter into the keeper and for guiding the ejecting guide bolt on its path in the form of a broken line when it moves from one of its two positions to the other.

Other characteristics of the invention will emerge from a reading of the following description and claims and from an examination of the accompanying drawing which is given solely by way of example and in which:

FIGS. 3A, 3B, 3C and 3D are detailed diagrammatic views of the insertion and retention system for the means of the buckle according to the invention;

FIGS. 6A and 6B are partial detailed diagrammatic views in longitudinal section of the embodiment of FIG. 5;

FIG. 7 is a partial detailed view of an embodiment of a buckle according to the invention, equipped with its detector and with its lighting device;

Figure 1:
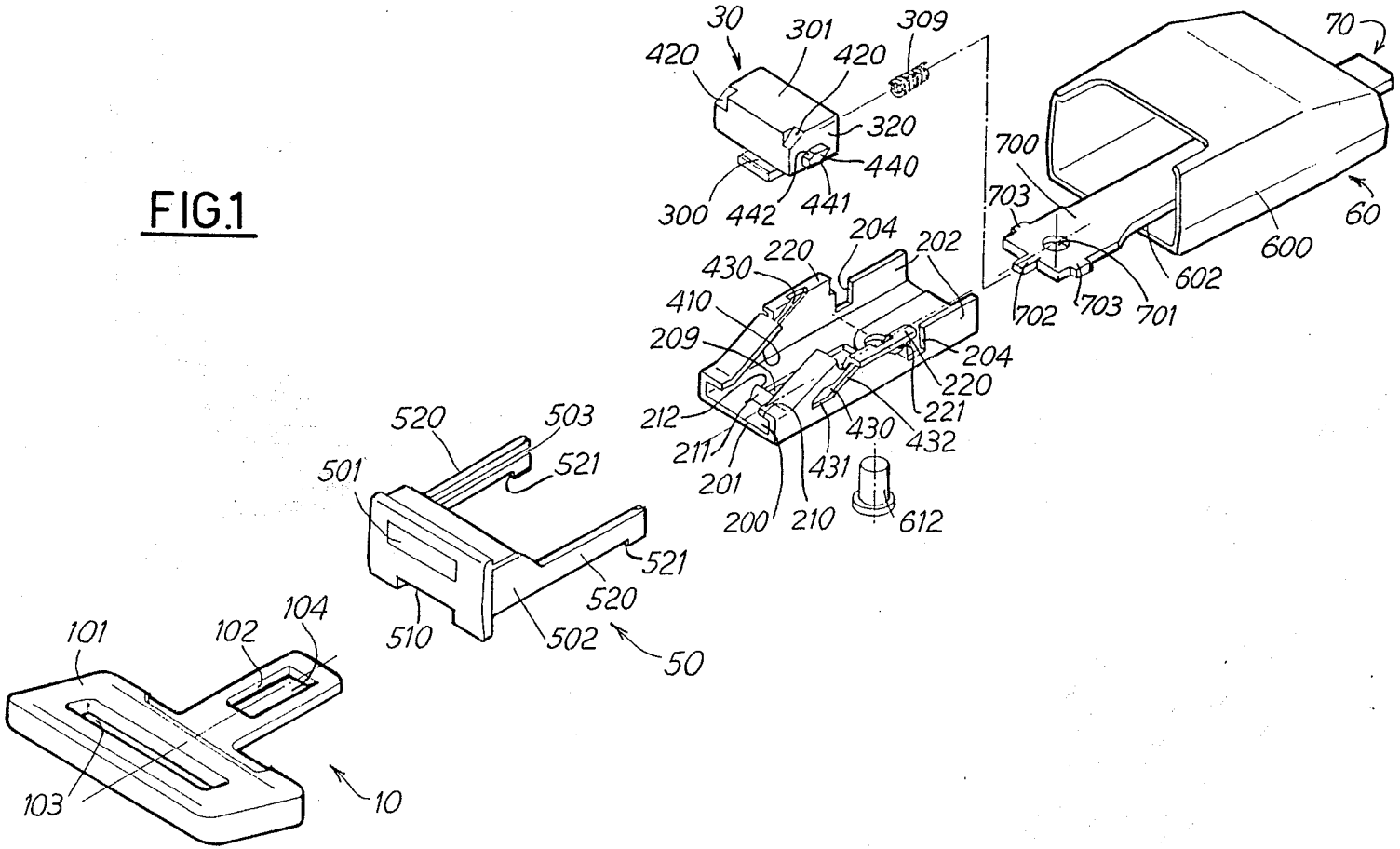
FIG. 1 is an exploded perspective view of one embodiment of a safety-belt buckle according to the invention.

Since safety-belt buckles are well known in the art, particularly where their use on land-based motor vehicles are concerned, only what relates directly or indirectly to the invention will be described hereafter. For the rest, a specialist in the art in question will draw from the conventional solutions currently available to him to deal with the specific problems with which he is faced.

The description will always employ the same reference numeral to designate a particular identical element, whatever the embodiment.

Referring especially to FIG. 1, it can be seen from this that a safety-belt buckle according to the invention comprises a latch 10 intended to be locked on a keeper when the buckle is closed. This keeper comprises a base 20, an ejecting guide bolt 30, an actuating button 50, if appropriate a protective casing 60, a securing connection 70 intended for anchoring the keeper to a body or structure of a vehicle (not shown), and, if need be a locking detector 80 and a lighting device 90. This buckle also possesses means 40 for safeguarding the ejecting guide bolt in the locked position, for inserting and retaining the latch and for guiding the ejecting guide bolt.

For the convenience of the description, each of the components of the embodiment of a buckle according to the invention will be described in succession, before mention is made of its mode of operation.

The latch 10 comprises a body 101 which is continued in the form of an extension 102. The body 101 has passing through it a passage 103 intended for receiving the end of a safety-belt band (not shown), and the extension 102 has passing through it a cutout 104, by means of which the latch is held locked on the keeper when the buckle is closed.

The base 20 takes the form of a U-shaped piece. As can be seen, the bottom 201 is edged by two virtually parallel flanks 202. Located on the bottom 201 is a nose 210 which has an inclined face 211 and which terminates in an edge 212. This nose is obtained, for example, by cutting out an orifice 209 in the bottom 201. This bottom also has passing through it a hole 214 which will be discussed later. Each of the flanks 202 has a perforation 204 passing through it and possesses a lug 220 and a turned-in portion 221. Each of the flanks is also equipped with a cam 410 and has passing through it a slot 430 in the form of a broken line, which possesses a flat 431 and a ramp 432. A channel 200 intended for receiving the extension 102 of the latch is thus delimited by the bottom 201, the face 211, part of the two flanks 202 and the cam 410.

The ejecting guide bolt 30 takes the form of an approximately parallelepipedic block 301, on two of the opposite faces of which are arranged a receptacle 300 and a stud 310. The receptacle 300 has a bevel 301 at its entrance and is delimited by a ceiling 302, a partition 303 and a floor 304. This receptacle is intended for receiving the extension 102 of the latch 10. Arranged on two opposite cheeks 320 of the block 301 are cam followers 420 and wings 440 which, as illustrated, are composed of a flattened portion 441 and of at least one slope 442.

The actuating button 50 comprises a frontage 501, in which is made a mouth 510 intended for allowing the extension 102 of the latch to pass through. Associated with this frontage 501 are side walls 502 which are extended by fingers 520 terminating in a shoulder 521. A groove 503 is made in each of the fingers 520 and walls 502.

The protective casing 60 consists, for example, of a housing 600 which has a relatively rigid and flexible lip 602. This housing is produced, for example, in one piece or from two half-shells joined to one another by any suitable technique, for example by interlocking, mortising, welding, adhesive bonding or the like.

The securing connection 70 comprises a rod 700, one of the ends of which is equipped with a stud 702 and with two protuberancies 703. A hole 701 passes through this rod and is intended to be matched with the hole 214 in the bottom 201 of the base 20, in order to receive a rivet, eyelet or the like 612. This rivet or the like makes it possible to connect the keeper and the anchorage point.

A spring 309 is intended to be slipped simultaneously onto the stud 310 of the ejecting guide bolt 30 and onto the stud 702 of the securing connection 70.

The means 40 of the buckle according to the invention consist of a safeguarding arrangement comprising the cam 410 and the cam follower 420, of a guide device comprising the slots 430 and the wings 440 together with an insertion and retention system comprising the receptacle 300 with its bevel 301.

Preferably, the body 101 with the extension 102 of the latch are made of metal and if appropriate at least where the body is concerned are covered with plastic, as is customary and illustrated. The base 20 is preferably made of metal and obtained by the cutting out, stamping and bending of a suitable sheet, at the same time making "half-plunged bosses", if necessary. The ejecting guide bolt 30, the actuating button 50 and the protective casing 60 are preferably obtained by the moulding of suitable plastics. The securing connection 70 is preferably made of metal.

To carry out the assembly of this embodiment of a safety-belt buckle according to the invention, the procedure given below, for example, will be followed.

The rod 700 is brought near to the base 20 and its protuberances 703 are engaged in the perforations 204, and then these two components are assembled together and kept connected by means of the river or eyelet 612 introduced through the holes 214 and 701. Subsequently, the ejecting guide bolt 30, suitably oriented, is offered in such a way that its wings 440 are vertically in line with the slots 430, into which they are engaged. When this has been done, the spring 309 is put onto each of the studs 310 and 701 which hold it in place. The actuating button 50 is then offered in such a way that the grooves 503 of its fingers 520 confront the lugs 220. The button is then made to slide on the base, in such a way that its fingers 520 pass across the turned-in portions 221, at the same time moving relatively apart from one another as a result of elastic deformation, made easier by suitable chamfers, until the shoulders 521 escape from the turned-in portions 221 and resume their position behind these. The actuating button can thus slide in translational motion relative to the base, without being capable of coming away from this. Assembly is completed, if appropriate, by causing the housing 600 to slide on the rod 700, until the lip 602 is caught and locked on the edge of the base as a result of elastic deformation. The result of all this is illustrated clearly in FIGS. 2A, 2B and 2C.

The mode of operation of this embodiment of the buckle according to the invention is as follows. Reference will be made more particularly to FIGS. 2, 3 and 4.

It will be pointed out first of all that, as emerges especially clearly from the illustrations in the Figures of the drawing, the channel 200 and the receptacle 300 are inclined relative to one another and oriented in such a way that the channel 200 has a slant rising in the direction of the receptacle 300. Because it is mounted on the base by means of its wings 440 engaged in the slots 430, it can be seen that the ejecting guide bolt 30 is mounted movably on the base 20 so as to be capable of following a path in the form of a broken line between a first retaining position, towards which it is normally stressed elastically by the spring 309, and a second position, towards which it is pushed momentarily during the introduction of the latch into the keeper for locking it.

It can also be seen that, as a result of the mutual engagement of the grooves 503 and lugs 220 of the actuating button and of the base respectively, the actuating button 50 is mounted on the base 20 movably in translational motion between an inactive position, towards which it is elastically stressed indirectly by the ejecting guide bolt 30 and which it occupies when the latter is in its first position, and an active position for causing the ejecting guide bolt 30 to pass from its first position to its second position, in order to release the latch from the keeper when pressure is exerted manually on the frontage of the actuating button so as to push it into the protective casing.

Figure 2A:
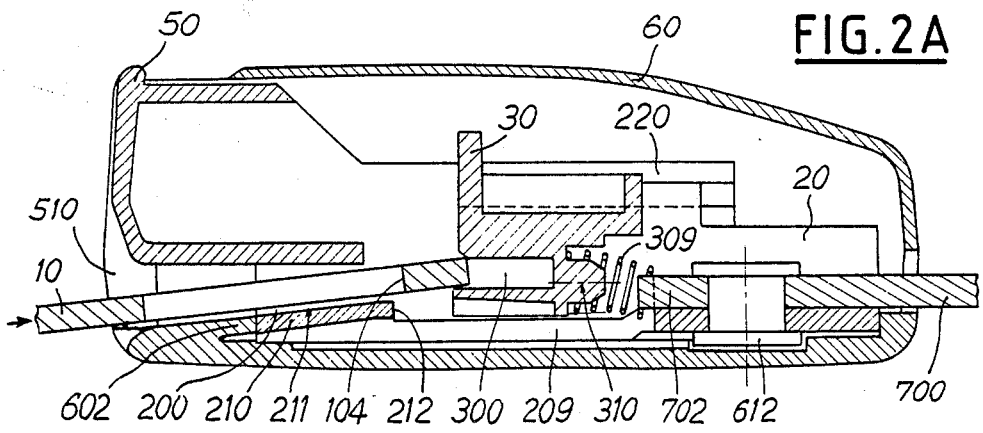
FIGS. 2A, 2B and 2C are diagrammatic longitudinal sections through the assembled buckle according to FIG. 1, illustrating different phases of its operation.

To close the buckle according to the invention, as can be seen especially from FIG. 2A, the extension 102 of the latch 10 is introduced into the mouth 510 of the actuating button 50 and is made to travel along in the inclined channel 200, until its free leading end meets the bevel 301 of the receptacle 300. As a result of this, when the force represented by the arrow of FIG. 2A continues to be exerted, the ejecting guide bolt 30 is progressively pushed back and, as it retreats, compresses the spring 309. Because the slots 430 are in the form of a broken line, it will be appreciated that the ejecting guide bolt 30 first retreats by remaining in its plane virtually parallel to the receptacle and then rises progressively. Because of its progressive rise, the receptacle 300 of the ejecting guide bolt 30 then takes up position in the extension of the channel 200 and the leading edge of the latch can engage into the receptacle 300. This insertion of the latch into the receptacle is made easier by the shape of the bevel 301 which will be dealt with in more detail later.

Figure 2B:
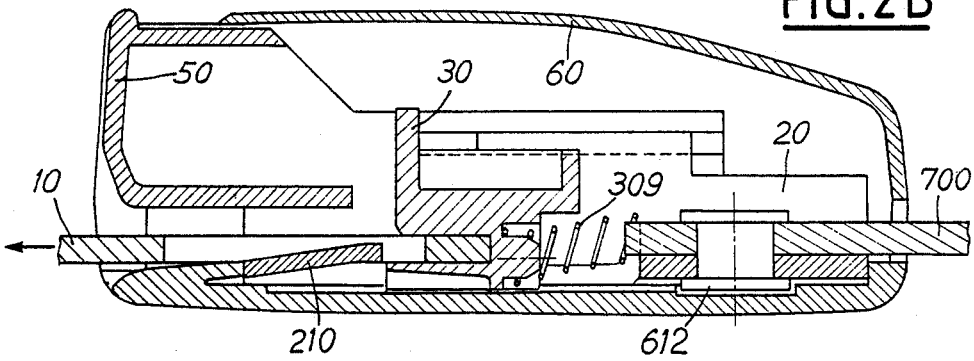

Thus, it can be seen that the cutout 104 in the extension 102 of the latch 10 is therefore now above the nose 210. The width of this cutout 104 is a little larger than the width of the nose 210, so that the latter can engage freely into it. Because the extension 102 of the latch 10 is engaged completely in the receptacle 300 of the ejecting guide bolt 30, ceasing to push the latch 10 into the keeper in the direction of the arrow causes the spring 309, which has been compressed during this phase, to expand progressively, thereby pushing back the ejecting guide bolt 30, as illustrated in FIG. 2B. During this operating phase, the ejecting guide bolt 30 returns to its initial position, namely its first retaining position (FIG. 2C), descending in order to resume its original level, at the same time carrying the latch with it. The ejecting guide bolt 30, by returning towards its first position, forces the latch towards the nose and the extension of the latch catches on the edge 212 of the nose. In the final locking phase, the buckle according to the invention is in the configuration illustrated in FIG. 2C.

Figure 2C:
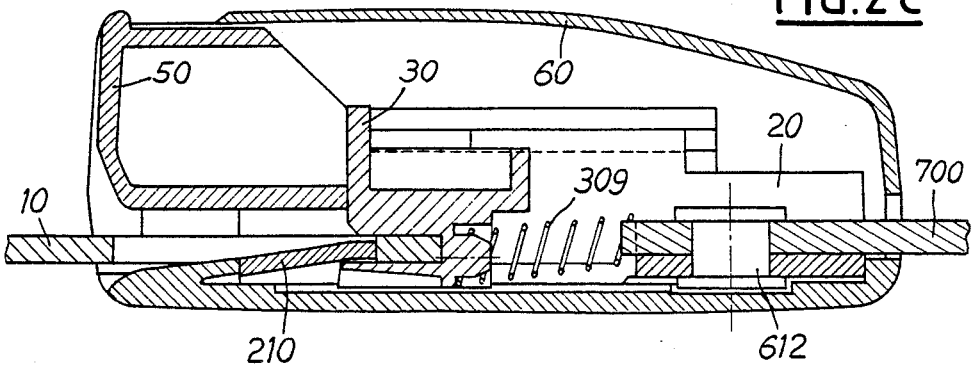

When the buckle assumes the position in which it is shown in FIG. 2C, it will be appreciated that the cam 410 and cam follower 420 have come in contact with one another and ensure that the ejecting guide bolt 30 is wedged in the position illustrated. It can therefore be seen that the buckle is then in such a position that the latch locked directly on the base is also safeguarded in this position, thus resulting in a very high degree of safety in the closing of the buckle. This very high degree of safety is increased further because of the direct junction between the securing connection 70 and the base 20 which is made as a result of the mutual engagement of the protuberances 703 and perforations 204. The rivet, eyelet or the like 610 undergoes a reduced shearing force and is there essentially in order to hold the rod 700 and base 20 together or connect them to one another.

Figure 4A:
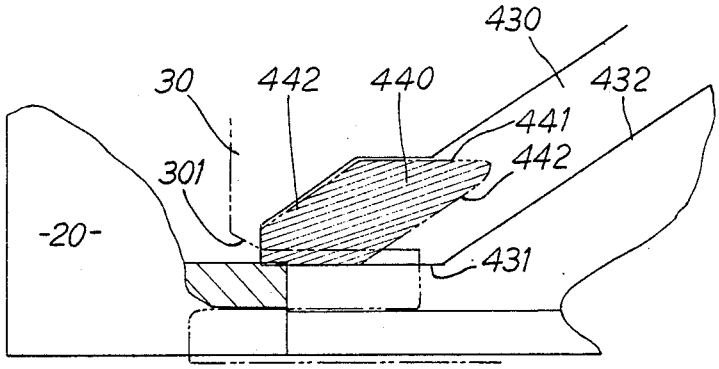
FIGS. 4A and 4B are partial detailed diagrammatic views illustrating the buckle according to the invention in two different phases of its operation.
Figure 4B:
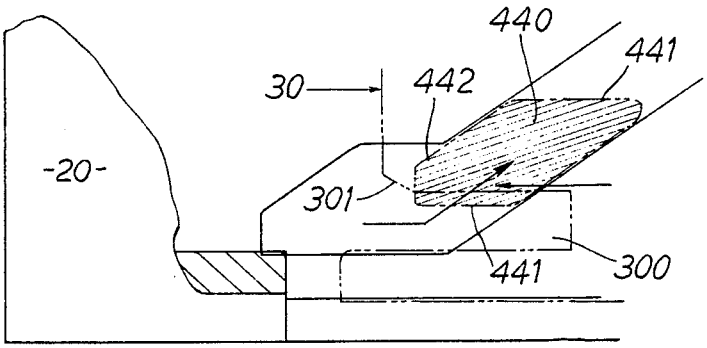

In order to release the buckle, it is thus sufficient to press on the actuating button 50 in order to push it in. The kinematics of the buckle are then those illustrated diagrammatically in FIGS. 4A and 4B. FIG. 4A corresponds to the state of the buckle in the locked and safeguarded position. When the actuating button 50 is pushed in, it bears on the ejecting guide bolt 30 which it pushes back (see FIG. 2C). The ejecting guide bolt 30, by retreating, first slides in its own plane and then rises. As a result of this, since the extension 102 of the latch is retained in the receptacle 300, the ejecting guide bolt 30 carries with it the extension 102 which thus comes away from the nose 210. When the lower face of the latch is at a level higher than that of the upper face of the nose, the least force exerted on the latch, for example by means of the end of the band, is sufficient to free the latch from the receptacle. The ejecting guide bolt 30 is then pushed back by its spring 309 which expands, the actuating button 50 having been released. As a result, the ejecting guide bolt 30 then ejects the latch from the keeper completely, if it had not already been discharged from it.

Referring to the various illustrations of FIGS. 3A, 3B, 3C and 3D, it will be seen that the bevel 301 can have various forms. In FIG. 3A, it takes the form of a portion of a cylinder with a relatively large radius. In FIG. 3B, this radius is the same, but the bevel is more inclined. In FIG. 3C, it is a plane chamfer, and in FIG. 3D it is a combination of a plane chamfer and of a portion of a cylinder. It will easily be appreciated that the choise of the exact forms given to this bevel 301 depends on the type and surface states of the parts of the ejector guide bolt 30 and of the latch 10 which are intended to come in contact and interact. It must be possible for this bevel to guide the extension of the latch so that the latter engages firmly into the receptacle without any appreciable force.

Figure 5:
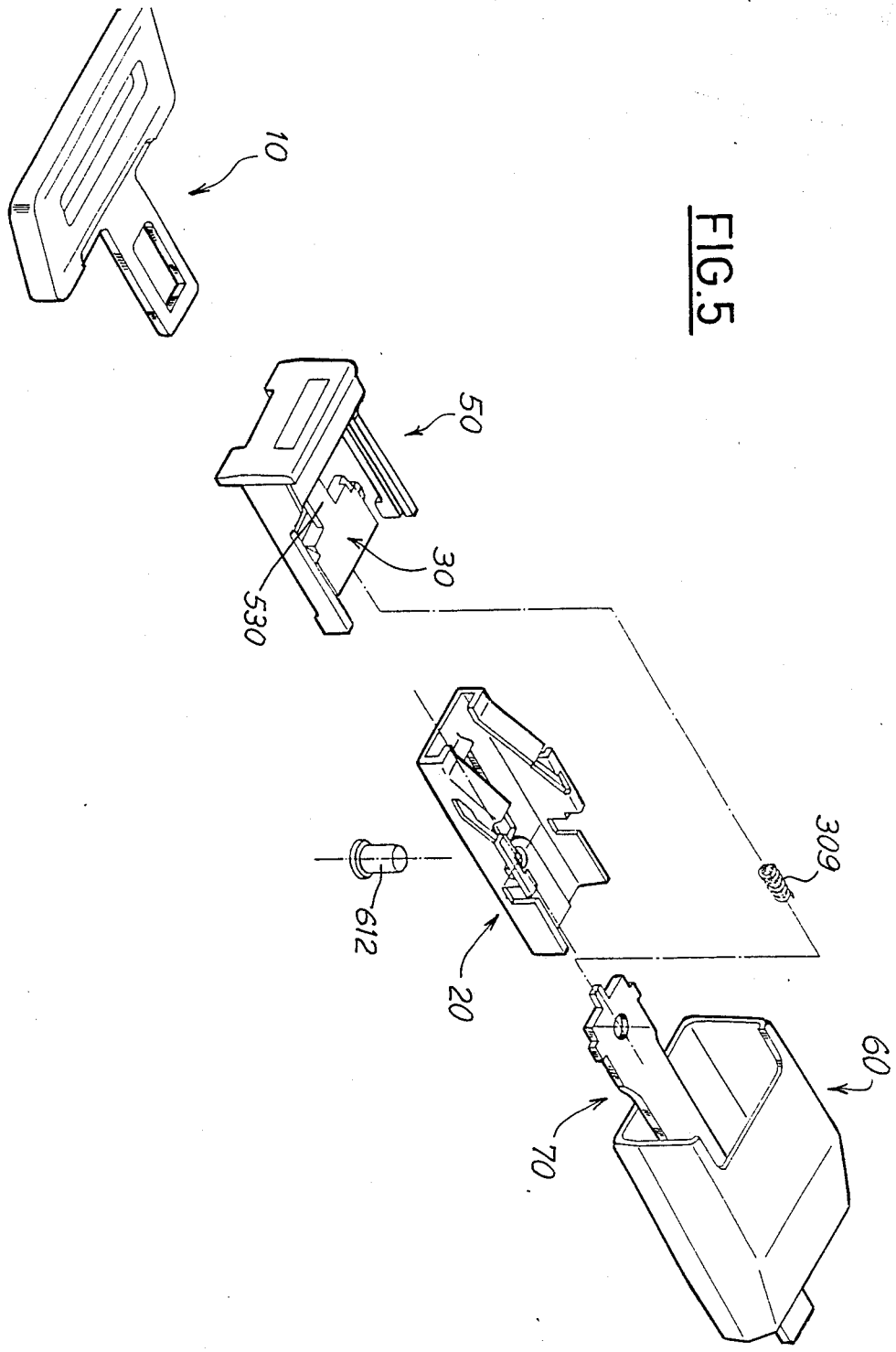
FIG. 5 is an exploded perspective view of another embodiment of a buckle according to the invention.

FIG. 5 is an exploded view, similar to that of FIG. 1, of another alternative embodiment of the buckle according to the invention, where the actuating button 50 and the ejecting guide bolt 30 are produced in one piece, for example from a moulded plastic. As can be seen, the ejecting guide bolt 30 and the actuating button 50 are connected by means of a web 530 bordered, at each of its ends, by scores 531 and 532 which form there weakening zones permitting some flexibility which thus allows the movements of the button and of the bolt to be made relatively independent of one another, the actuating button moving in a straight translational motion, whilst the bolt moves along a path in the form of a broken line.

FIG. 7 shows the locking detector 80 and the lighting device 90 which are mounted on a common support 89 fastened to the base 20, for example by snapping, as is customary and therefore not explained in detail. The detector 80 consists, for example, of a microswitch 800, the operating member 801 of which is placed in the path of the latch in order to detect the presence of the latter in the locked position. This microswitch is associated with conventional electrical circuits, so as to actuate a luminous and/or accoustic signal to indicate that a passenger in the vehicle has not locked his belt.

The lighting device 90 consists, for example, of a light-emitting diode or of a miniature bulb. This device is intended for illuminating at least the channel for the introduction of the latch into the keeper, in order to make it easier to lock the belt. This device is associated with a conventional electrical circuit of any known type, in such a way that the bulb lights up when the doors are opened, for example simultaneously with the ceiling lamp, or when the vehicle lighting, for example the parking lights or low-beam or high-beam headlamps, are switched on.

Figure 8:
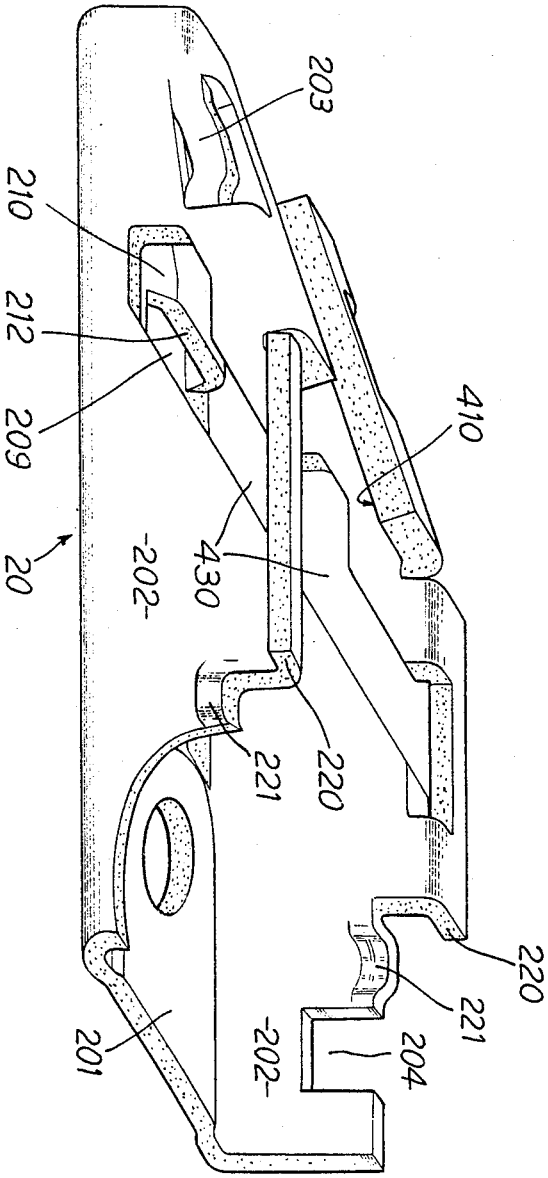
FIG. 8 is an isometric projection of an alternative embodiment of the base of the keeper of a safetybelt buckle according to the invention.

According to another alternative embodiment illustrated in FIG. 8, the base 20 is somewhat modified. In this embodiment, bosses 203, for example "half-plunged bosses", have been formed on each of the flanks 202, so as to use them to contribute to delimiting the channel 200. In this case, the channel is delimited by the bottom of the base, the face of the nose, a part of the two flanks and the bosses in question.

The mode of operation is otherwise the same. Here again, a single spring ensures the elastic stressing of the ejecting guide bolt and of the actuating button.

According to an embodiment which is not illustrated, the receptacle 300 of the ejecting guide bolt 30 is such that its floor 304 is no longer in one piece, but on the contrary consists of a flexible central sole piece bordered on either side by rigid lateral tongues. The level of the floor is somewhat higher than that of the lateral tongues, so that a certain constraint can be exerted in order to retain the latch momentarily in its receptacle, as in the preceding embodiment, so that it "follows" the ejecting guide bolt during the opening of the buckle when the actuating button is pressed in order to push it in. It is thus possible to understand all the usefulness and all the advantages of the buckle according to the invention which, with the very least possible number of components of relatively simple shape and relatively easy to produce, especially in series, ensures that the latch is safeguarded when the latter is locked.

I claim:

1. Buckle for a safetybelt, especially of motor vehicles used on land, which is intended for connecting a band to an anchorage point and which is composed, among other things, of a latch (10) and of a keeper comprising particularly a base (20) which delimits a channel (200) for receiving the latch (10) at least partially and which is equipped with a nose (210), on which the latch (10) can catch directly when it is locked on the keeper, and, carried by this base, an ejecting guide bolt (30) which delimits a receptacle (300) for receiving the latch (10) at least partially and which is mounted on the base (20) movably between a first retaining position, towards which it is normally stressed elastically, and a second position, towards which it is pushed momentarily during the introduction of the latch. (10) into the keeper for locking it, and an actuating button (50) mounted on the base (20) movably in terms of translational motion parallel to the receptacle (300) between an inactive position, towards which it is normally stressed elastically and which it occupies when the ejecting guide bolt (30) is in its first position, and an active position for causing the ejecting guide bolt (30) to pass from its first position to its second position in order to release the latch (10) from the keeper, wherein the channel (200) and the receptacle (300) are inclined relative to one another and are oriented in such a way that the channel (200) has a slant rising in the direction of the receptacle (300), the ejecting guide bolt (30), when it moves from its first position to its second position, follows a path in the form of a broken line, first approximately parallel to the receptacle (300) and then oblique relative to the latter, and vice versa, and it possesses means (40) for safeguarding the bolt (30) in its first position, for inserting and retaining the latch (10)in the receptacle (300) of the ejecting guide bolt (30) and for guiding the ejecting guide bolt (30) on its path in the form of a broken line when it moves from one of its two positions to the other.

2. Buckle according to claim 1, characterized in that these means (40) comprise a safeguarding arrangement (410–420).

3. Buckle according to claim 2, characterized in that this safeguarding arrangement (410–420) consists of at least one cam (410) of the base and of at least one cam follower (420) of the ejecting guide bolt (30) which interact by wedging when the ejecting guide bolt (30) is in its first position.

4. Buckle according to claim 1, characterized in that these means (40) comprise an insertion and retention system (301, 302, 303 and 304).

5. Buckle according to claim 4, characterized in that this insertion and retention system (301, 302, 303 and 304) consists of a bevel (301) located at the entrance of the receptacle (300) of the ejecting guide bolt (30) and of a ceiling (302), partition (303) and floor (304) delimiting this receptacle (300).

6. Buckle according to claim 1, characterized in that these means (40) include a guide device (430–440).

7. Buckle according to claim 6, characterized in that this device (430–440) consists of at least one slot (430) which is made in the base (20) and into which is engaged at least one wing (440) of the ejecting guide bolt (30).

8. Buckle according to claim 7, characterized in that the slot (430) comprises a flat (431) virtually parallel to the receptacle (300) and a ramp (432) oblique relative to the flat (431).

9. Buckle according to claim 1, characterized in that the channel (200) is delimited by a part of two opposite flanks (202) of the base (20), a face (211) of the nose (210) and the cams (410).

10. Buckle according to claim 1, characterized in that the channel (200) is delimited by a part of the two opposite flanks (202) of the base (20), bosses (203) formed on the flanks (202), and a face (211) of the nose (210).

11. Buckle according to claim 5, characterized in that the floor (304) comprises a flexible middle sole piece bordered by rigid lateral tongues located at a level below that of the sole piece.

12. Buckle according to claim 1, characterized in that the elastic stressing of the ejecting guide bolt (30) and of the button (50) is obtained by means of a single spring (309.

13. Buckle according to claim 1, characterized in that the ejecting guide bolt (30) and the button (50) are fixed to one another.

14. Buckle according to claim 13, characterized in that the ejecting guide bolt (30) and the button (50) are made in one piece.

15. Buckle according to claim 12, characterized in that the ejecting guide bolt (30) and the button (50) are connected to one another by means of a web (530) delimited by two scores (531–532) allowing local bending.

16. Buckle according to claim 1, characterized in that it possesses a locking detector (80).

17. Buckle according to claim 16, characterized in that the locking detector (80) comprises a microswitch (800), an operating member (801) of which is located in the path of the latch (10).

18. Buckle according to claim 16, characterized in that it possesses a lighting device (90).

19. Buckle according to claims 18, characterized in that the detector (80) and the lighting device (90) are mounted on a common support (89).

20. Buckle according to claim 1, characterized in that the keeper is seated at least partially in a protective casing (60).

* * * * *